US011525301B2

(12) United States Patent
Taylor et al.

(10) Patent No.: US 11,525,301 B2
(45) Date of Patent: Dec. 13, 2022

(54) ROLLUP WINDOW COVER

(71) Applicants: Joseph Curtis Taylor, Birch Run, MI (US); Jack Roy Taylor, Clio, MI (US)

(72) Inventors: Joseph Curtis Taylor, Birch Run, MI (US); Jack Roy Taylor, Clio, MI (US)

( * ) Notice: Subject to any disclaimer, the term of this patent is extended or adjusted under 35 U.S.C. 154(b) by 0 days.

(21) Appl. No.: 17/350,709

(22) Filed: Jun. 17, 2021

(65) Prior Publication Data

US 2021/0396075 A1 Dec. 23, 2021

Related U.S. Application Data

(60) Provisional application No. 63/040,849, filed on Jun. 18, 2020.

(51) Int. Cl.
*E06B 9/42* (2006.01)

(52) U.S. Cl.
CPC ..... *E06B 9/42* (2013.01)

(58) Field of Classification Search
CPC ..... E06B 9/42; E06B 9/40; E06B 9/64
USPC ..... 160/323.1
See application file for complete search history.

(56) References Cited

U.S. PATENT DOCUMENTS 1,544,268 A 6/1925 Murray
1,571,543 A 2/1926 Fratzke
1,615,931 A * 2/1927 Cann ..... F01P 7/10 160/243
2,205,614 A 6/1940 Bashe
2,264,962 A 12/1941 Adams
2,299,173 A * 10/1942 Pidgeon ..... A47H 23/02 160/84.01
2,514,316 A * 7/1950 Dobrin ..... E06B 3/285 160/102
3,378,293 A 4/1968 Silk
3,661,413 A 5/1972 Silva
3,768,847 A 10/1973 Buck, Jr. et al.
(Continued)

FOREIGN PATENT DOCUMENTS

AU 2011256239 B2 1/2015
CN 203905678 U 10/2014
(Continued)

OTHER PUBLICATIONS

Office Action regarding U.S. Appl. No. 13/363,106, dated Nov. 20, 2013.

(Continued)

*Primary Examiner* — Beth A Stephan
(74) *Attorney, Agent, or Firm* — Harness, Dickey & Pierce, P.L.C.

(57) ABSTRACT

A window cover may include a cover body, a mounting feature, a first roll-up-securing feature, a second roll-up-securing feature, a pull-strap, and a weight. The cover body can be moved between a rolled-up position and a deployed position. The mounting feature may be secured to a first side of the cover body and can attach the cover body above a window. The first roll-up-securing feature is secured to a second side of the cover body. The second roll-up-securing feature is secured to the first side of the cover body and is configured to engage the first roll-up-securing feature to retain the cover body in the rolled-up position. The pull-strap may be attached to the first side of the cover body and is accessible when the cover body is in the rolled-up position.

20 Claims, 7 Drawing Sheets

(56) References Cited

U.S. PATENT DOCUMENTS 3,833,963 A 9/1974 Waters
3,913,655 A * 10/1975 Ogino ..... E06B 9/262 160/354
3,973,420 A 8/1976 Brady et al.
4,017,105 A 4/1977 Paxton
4,068,428 A * 1/1978 Peterson, III ..... E06B 3/28 160/354
4,139,249 A 2/1979 Hillman
4,163,574 A 8/1979 Chezem
4,208,841 A 6/1980 Starks
4,270,668 A 6/1981 Berfield
4,274,666 A 6/1981 Peck
4,303,265 A 12/1981 Beard
4,579,377 A 4/1986 Dallaire et al.
4,714,284 A 12/1987 Varlet
4,792,168 A 12/1988 Kardosh
4,822,084 A 4/1989 Fox
4,836,265 A * 6/1989 Bussert ..... A47H 99/00 160/354
4,907,832 A 3/1990 Pemberton
4,909,299 A * 3/1990 Bussert ..... E06B 9/24 160/354
4,932,694 A 6/1990 Cater, Sr.
4,955,648 A 9/1990 Miller
5,010,944 A * 4/1991 Bussert ..... A47H 99/00 160/354
5,025,848 A * 6/1991 Prochaska ..... E06B 9/24 160/354
5,040,835 A 8/1991 Barker
5,074,022 A * 12/1991 Bussert ..... E06B 9/24 29/525
5,199,759 A 4/1993 Anderson
5,203,596 A 4/1993 Stevens
5,209,018 A 5/1993 Heinrich
5,226,201 A 7/1993 Lefebvre
5,292,013 A 3/1994 Earl
5,383,254 A 1/1995 Wigley, Sr.
5,427,169 A * 6/1995 Saulters ..... E06B 9/0692 160/DIG. 18
5,445,451 A 8/1995 Harmony
5,454,143 A 10/1995 Wigley, Sr.
5,454,610 A 10/1995 Taylor et al.
5,531,490 A 7/1996 Parker
5,549,338 A 8/1996 Wingfield et al.
5,590,918 A 1/1997 Kambalov
5,590,928 A 1/1997 Voiculescu
5,601,320 A 2/1997 Miller
5,645,304 A 7/1997 Richardson et al.
D384,875 S 10/1997 Sayler et al.
5,771,533 A 6/1998 Kuang-Pin
5,865,484 A 2/1999 Johns
5,904,325 A 5/1999 Hung
5,996,674 A * 12/1999 Gatewood ..... A47H 21/00 160/368.1
D419,052 S 1/2000 Laporte et al.
6,082,431 A 7/2000 Decola
6,167,655 B1 1/2001 Santa Cruz et al.
6,340,185 B1 1/2002 Truong
6,352,290 B1 3/2002 Scottino
6,382,689 B1 5/2002 Brown
6,397,645 B1 6/2002 Grant, Jr.
6,429,961 B1 * 8/2002 Harary ..... E06B 3/5418 52/204.67
6,471,264 B1 10/2002 Ryan
6,484,445 B2 11/2002 Chang
6,550,828 B2 4/2003 Warden
6,655,720 B2 12/2003 Rampen
6,666,486 B1 12/2003 Fleming
6,675,860 B2 * 1/2004 Steele ..... E06B 3/285 160/237
7,320,353 B1 * 1/2008 Miller ..... E06B 3/80 160/368.1
7,651,140 B2 1/2010 Leggio
D612,717 S 3/2010 Frankel
7,731,252 B1 6/2010 Stewart
7,805,897 B2 * 10/2010 Holland ..... E06B 9/02 52/222
8,096,593 B2 1/2012 Gibbons
8,510,994 B2 8/2013 Scott
8,511,002 B2 * 8/2013 Bowie ..... E04B 1/72 52/DIG. 4
8,888,146 B2 11/2014 Taylor et al.
8,894,110 B2 11/2014 Taylor et al.
D728,264 S * 5/2015 Bacolas ..... D6/575
9,482,034 B2 11/2016 Atkinson, Jr.
9,534,430 B2 1/2017 Taylor et al.
9,957,741 B2 5/2018 Taylor et al.
D860,682 S 9/2019 Gaetano
D880,897 S * 4/2020 Norton ..... D6/575
10,689,890 B2 6/2020 Taylor et al.
D903,372 S * 12/2020 Stanley ..... D6/575
10,871,030 B2 * 12/2020 Larsen ..... E06B 9/42
11,053,730 B1 * 7/2021 Camarillo ..... E06B 9/24
D933,998 S * 10/2021 Guinn ..... D6/575
2002/0067046 A1 6/2002 Cox
2006/0081344 A1 * 4/2006 McKearney ..... E06B 9/24 160/368.1
2008/0000595 A1 * 1/2008 Cohen ..... E06B 9/40 160/243
2009/0127870 A1 5/2009 Leggio
2010/0155001 A1 * 6/2010 Bolton ..... E06B 7/28 24/442
2010/0269985 A1 * 10/2010 Hanley ..... E06B 9/262 160/368.1
2011/0011137 A1 1/2011 Frankel
2011/0247767 A1 * 10/2011 Chen ..... E06B 9/42 160/290.1
2011/0291426 A1 12/2011 Gibson
2013/0193695 A1 8/2013 Taylor et al.
2014/0217754 A1 8/2014 Taylor et al.
2014/0251559 A1 * 9/2014 Loper ..... E06B 7/30 160/368.1
2014/0352899 A1 12/2014 Moolenbeek
2015/0048631 A1 2/2015 Ploskunak
2015/0076844 A1 3/2015 Taylor et al.
2015/0259973 A1 * 9/2015 Beaudoin ..... E06B 7/28 49/394
2016/0010372 A1 1/2016 Taylor et al.
2017/0145721 A1 5/2017 Taylor et al.
2019/0003221 A1 1/2019 Taylor et al.
2020/0318405 A1 10/2020 Taylor et al.
2021/0025205 A1 1/2021 Taylor et al.

FOREIGN PATENT DOCUMENTS

DE 1036482 B 8/1958
DE 202016001589 U1 6/2016
WO WO-2006015239 A2 2/2006

OTHER PUBLICATIONS

Office Action regarding U.S. Appl. No. 13/363,106, dated Mar. 13, 2014.
Office Action regarding U.S. Appl. No. 14/551,829, dated Jan. 16, 2015.
Office Action regarding U.S. Appl. No. 14/172,485, dated Mar. 25, 2014.
Office Action regarding U.S. Appl. No. 14/800,189, dated Mar. 29, 2016.
Office Action regarding U.S. Appl. No. 15/394,099, dated Jun. 6, 2017.
Office Action regarding U.S. Appl. No. 15/394,099, dated Oct. 17, 2017.
International Search Report regarding International Application No. PCT/US2018/040248, dated Nov. 16, 2018.
Written Opinion of the International Searching Authority regarding International Application No. PCT/US2018/040248, dated Nov. 16, 2018.
Fire Door Solutions LLC, "DoorArmor by Fire Door Solutions: Protecting Schools From Active Shooters." Retrieved from https://firedoorarmor.com/downloads/fire-door-armor.pdf.

(56) References Cited

OTHER PUBLICATIONS

Taylor Brothers Door Lock, LLC, "Nightlock® Lockdown 1." Retrieved from https://nightlock.com/door-security-devices/door-barricade/nightlock-lockdown/.
Office Action regarding U.S. Appl. No. 15/668,133, dated Sep. 10, 2019.
Search Report regarding European Patent Application No. 18823348.0, dated Mar. 5, 2021.
Office Action regarding Chinese Patent Application No. 201880043598.9, dated Oct. 27, 2020. Translation provided by Unitalen Attorneys at Law.
Office Action regarding Canadian Patent Application No. 3,068,307, dated Feb. 9, 2021.

* cited by examiner

ROLLUP WINDOW COVER

CROSS-REFERENCE TO RELATED APPLICATIONS

This application claims the benefit of U.S. Provisional Application No. 63/040,849, filed on Jun. 18, 2020. The entire disclosure of the above application is incorporated herein by reference.

FIELD

The present disclosure relates to a rollup window cover, and more particularly, to a rollup window cover for deployment in emergency situations.

BACKGROUND

This section provides background information related to the present disclosure and is not necessarily prior art.

In an emergency situation, such as an active-shooter situation, it may be beneficial to cover windows to restrict or prevent a person positioned outside of the room from seeing into the room or building through the window. The present disclosure provides a rollup window cover that can be quickly deployed in an emergency situation to block or limit a person's view through the window.

SUMMARY

This section provides a general summary of the disclosure, and is not a comprehensive disclosure of its full scope or all of its features.

In one form, the present disclosure provides a window cover that may include a cover body, a mounting feature, a first roll-up-securing feature, a second roll-up-securing feature, and a pull-strap. The cover body may include a top end, a bottom end, a first side, and a second side. The cover body is configured to be moved between a rolled-up position and a deployed position. The mounting feature may be secured to the first side of the cover body at or near the top end. The mounting feature may be configured to attach the top end of the cover body to a surface above a window or directly to the window. The first roll-up-securing feature may be secured to the second side of the cover body at or near the top end. The first side of the cover body may include a second roll-up-securing feature between the top and bottom ends. The second roll-up-securing feature may be configured to removably engage the first roll-up-securing feature to retain the cover body in the rolled-up position. The pull-strap may be attached to the cover body and may be accessible when the cover body is in the rolled-up position.

In some configurations, the window cover of the above paragraph includes a weight attached to the cover body at the bottom end.

In some configurations of the window cover of the above paragraph, the weight is a rod sewn into the cover body.

In some configurations of the window cover of any of the above paragraphs, the first and second roll-up securing features engage each other by hook-and-loop engagement.

In some configurations of the window cover of any of the above paragraphs, the first roll-up securing feature includes a first patch sewn to the second side of the cover body.

In some configurations of the window cover of any of the above paragraphs, the second roll-up securing feature includes a second patch sewn to the first side of the cover body.

In some configurations of the window cover of any of the above paragraphs, the first patch includes hooks of a hook-and-loop fastener, and the second patch includes loops of the hook-and-loop fastener.

In some configurations of the window cover of any of the above paragraphs, the second roll-up securing feature covers the entire first side of the cover body.

In some configurations of the window cover of any of the above paragraphs, the pull-strap is attached to the first side of the cover body, wherein the first side of the cover body faces the window when the cover body is in the deployed position.

In some configurations of the window cover of any of the above paragraphs, the pull-strap includes a first end and a second end, wherein the first end is fixedly attached to the first side of the cover body, and wherein the second end is unattached to the cover body.

In some configurations of the window cover of any of the above paragraphs, when the cover body is in the rolled-up position, a first portion of the pull-strap curls around a rolled-up portion of the cover body and a second portion of the pull-strap hangs downward from the cover body.

In some configurations of the window cover of any of the above paragraphs, the mounting feature includes a first mounting patch and a second mounting patch.

In some configurations of the window cover of any of the above paragraphs, the first mounting patch is secured to the surface above the window, wherein the second mounting patch is secured to the cover body at the top end.

In some configurations of the window cover of any of the above paragraphs, the first and second mounting patches form a hook-and-loop fastener.

In some configurations of the window cover of any of the above paragraphs, the cover body is formed from a fabric material.

In some configurations of the window cover of any of the above paragraphs, the cover body is opaque.

In some configurations of the window cover of any of the above paragraphs, the window is entirely blocked when the cover body is in the deployed position.

In some configurations of the window cover of any of the above paragraphs, the window is entirely uncovered when the cover body is in the rolled-up position.

In another form, the present disclosure provides a window cover that may include a cover body, a first mounting patch, a second mounting patch, a first roll-up securing feature, a second roll-up securing feature, a weight, and a pull-strap. The cover body has a top end, a bottom end, a first side, and a second side. The cover body is configured to be moved between a rolled-up position and a deployed position. The first mounting patch may be secured to the first side of the cover body at or near the top end. The second mounting patch may be secured to a surface above a window. The first and second mounting patches may engage each other by hook-and-loop engagement to attach the top end of the cover body to the surface above the window. The first roll-up-securing feature may be secured to the second side of the cover body at or near the top end. The first side of the cover body may include a second roll-up-securing feature between the top and bottom ends. The second roll-up-securing feature may be configured to removably engage the first roll-up-securing feature to retain the cover body in the rolled-up position. The weight may be attached to the cover body at the bottom end. The pull-strap may be attached to the cover body. The pull-strap is accessible when the cover body is in the rolled-up position. The pull-strap may be attached to the first side of the cover body, wherein the first side of the cover body faces the window when the cover body is in the deployed position. The pull-strap may include a first end and a second end. The first end of the pull-strap may be fixedly attached to the first side of the cover body. The second end of the pull-strap may be unattached to the cover body. When the cover body is in the rolled-up position, a first portion of the pull-strap may curl around a rolled-up portion of the cover body and a second portion of the pull-strap may hang downward from the cover body.

In some configurations of the window cover of the above paragraph, the cover body is formed from an a fabric material.

In some configurations of the window cover of either of the above paragraphs, the cover body is opaque.

In some configurations of the window cover of any of the above paragraphs, the window is entirely blocked when the cover body is in the deployed position.

In some configurations of the window cover of any of the above paragraphs, the window is entirely uncovered when the cover body is in the rolled-up position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
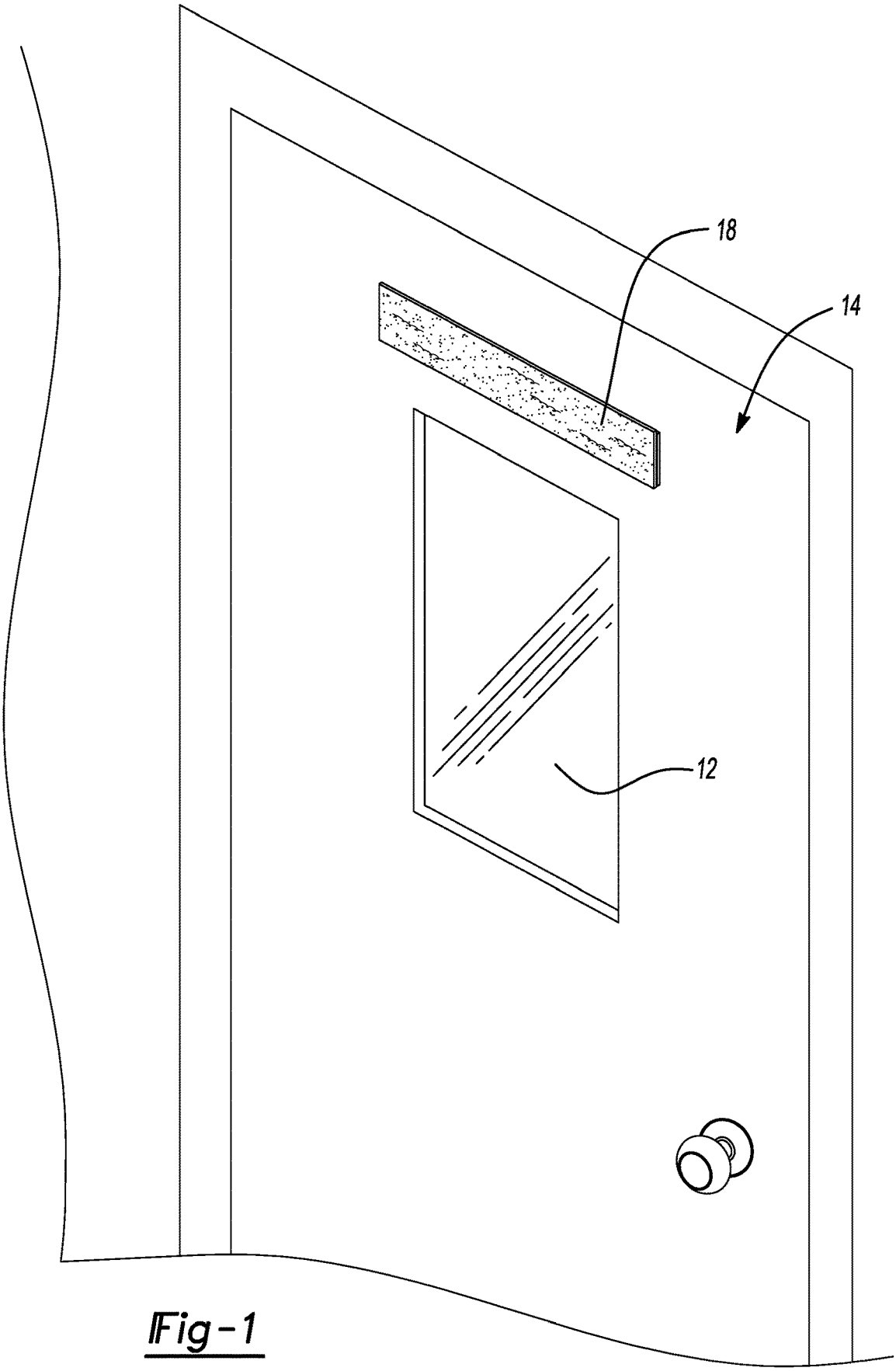
FIG. 1 is a schematic representation of a door of a room or building that has a window which can be selectively covered and uncovered by a window cover according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a rollup window cover 10 (FIGS. 2-5) is provided that may be installed onto or above a window 12 (FIG. 1) to selectively cover the window 12. The window 12 shown in FIG. 1 is a window formed in a door 14 of a room or building. It should be appreciated, however, that one or more of the window covers 10 could be installed on or above one or more windows in one or more walls of the room or building.

As will be described in more detail below, the window cover 10 can be moved between a rolled-up position (FIG. 2) in which the window 12 is exposed and an unrolled (deployed) position (FIG. 3) in which the window 12 is covered (or at least partially covered) by the window cover 10 to restrict or prevent a person from seeing through the window 12. For example, the window cover 10 can be attached to a surface of the door 14 (or wall) that faces an interior of a room or building so that a person positioned outside of the room cannot see into the room or building through the window 12 when the window cover 10 is in the deployed position. Such functionality may be particular beneficial for improving the security of the room or building during an emergency situation such as an active-shooter situation or other emergency lockdown situation. The window cover 10 could also be deployed in non-emergency situations to block sunlight and/or increase privacy, for example.

The window cover 10 may include a cover body 16, one or more first mounting patches or features 18, one or more second mounting patches or features 20, one or more first roll-up-securing patches or features 22, one or more second roll-up-securing patches or features 24, one or more pull-straps 26, and one or more weights 28.

Figure 2:
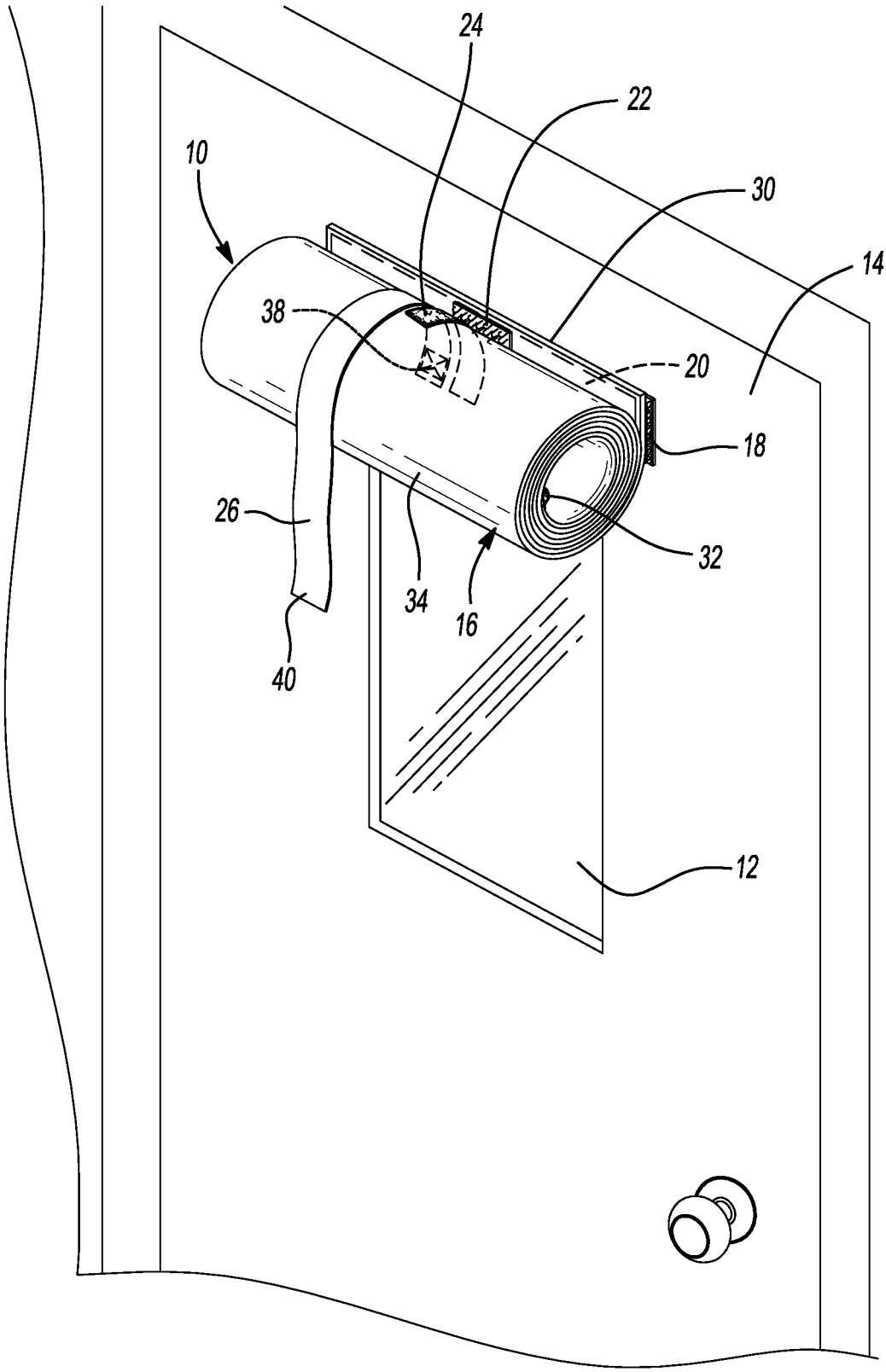
FIG. 2 is a perspective view of the window cover mounted on the door of FIG. 1 and in a rolled-up position.
Figure 3:
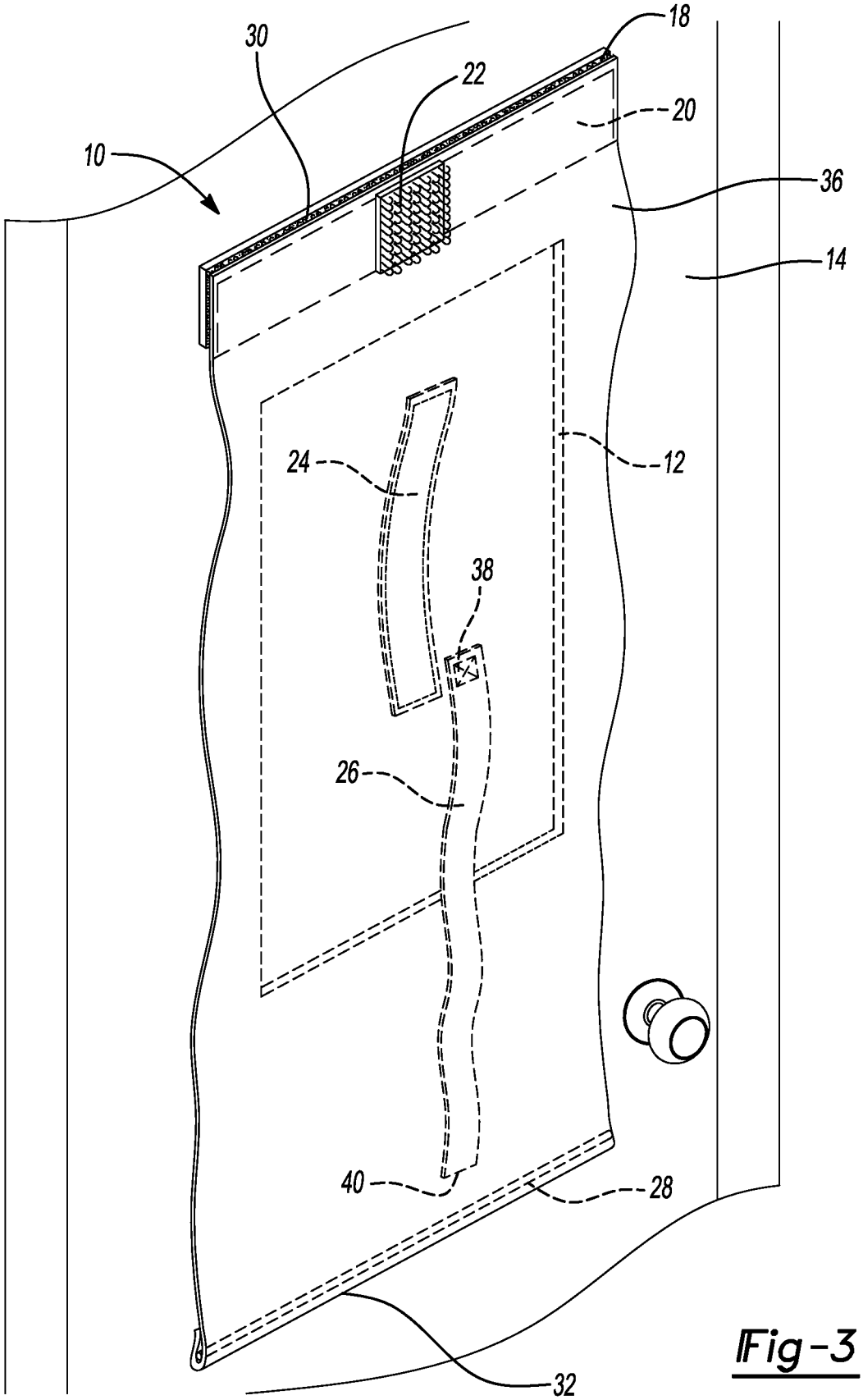
FIG. 3 is a perspective view of the window cover in a deployed position.

The cover body 16 may be flexible sheet formed from a fabric or polymeric material, for example. The cover body 16 may be sized to cover (or at least partially cover) the window 12 when the window cover 10 is in the deployed position. The material from which the cover body 16 is formed may be opaque to prevent a person from seeing through the cover body 16 when the window cover 10 is in the deployed position. The cover body 16 includes a top end 30, a bottom end 32, a first side 34 (FIGS. 2 and 4), and a second side 36 (FIG. 3). When the window cover 10 is installed on the door 14 (or wall) and is in the deployed position, the first side 34 may face toward the window 12 and the second side 36 may face away from the window 12.

The first and second mounting patches 18, 20 may be hook-and-loop fasteners. For example, the first mounting patch 18 may include the hooks and the second mounting patch 20 may include the loops. The first mounting patch 18 may be adhesively bonded (or otherwise secured) to the door 14 (or wall) above the window 12, as shown in FIG. 1. The second mounting patch 20 may be sewn and/or adhesively bonded (or otherwise secured) to the first side 34 of the cover body 16 at or near the top end 30. In this manner, the window cover 10 can be removably mounted to the door 14 (or wall) by pressing the second mounting patch 20 against the first mounting patch 18 (i.e., to engage the hook-and-loop fasteners). In the particular example shown in the figures, the widths of the first and second mounting patches 18, 20 are substantially equal to the width of the cover body 16.

Figure 4:
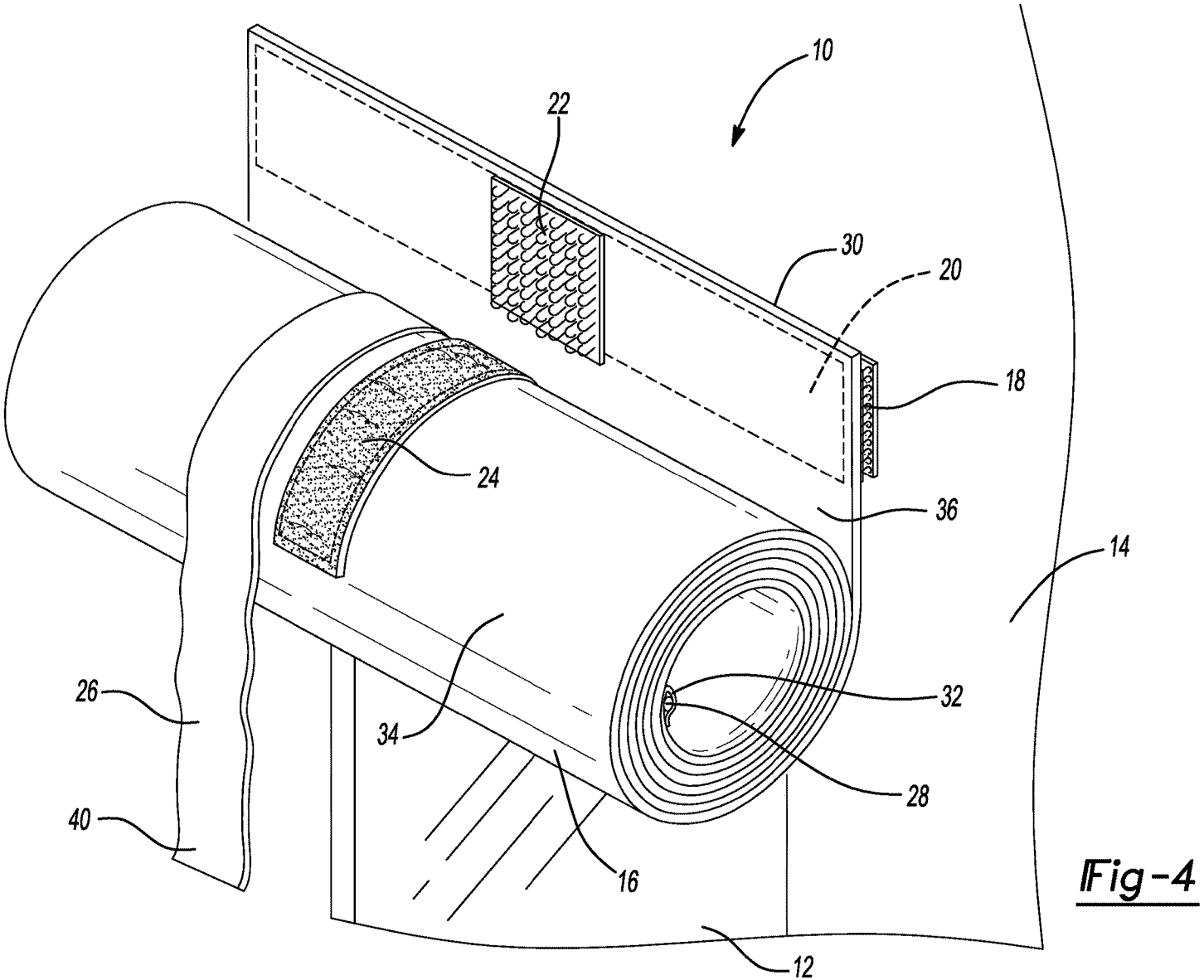
FIG. 4 is a perspective view of the window cover in a nearly rolled-up position.
Figure 5:
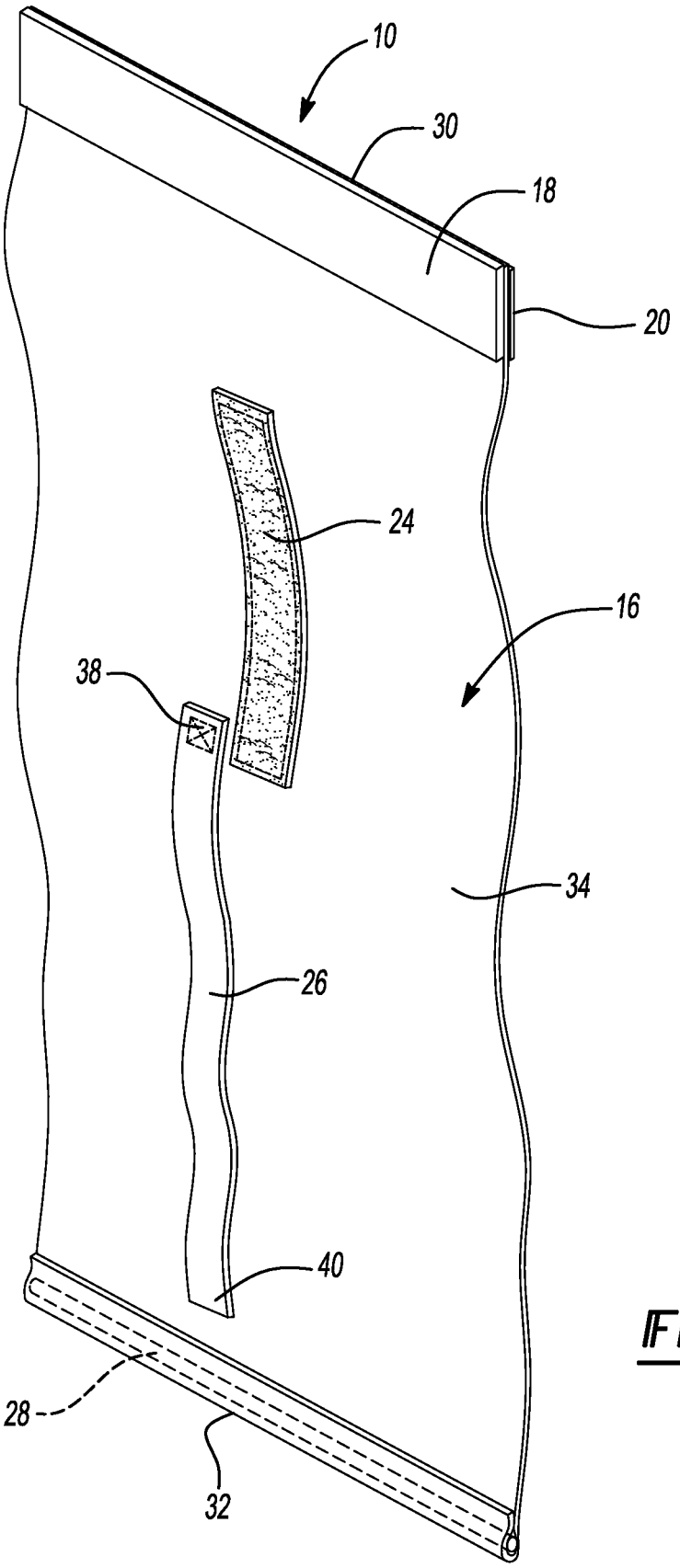
FIG. 5 is a perspective view of a first side of the window cover in the deployed position.

The first and second roll-up-securing patches 22, 24 may be hook-and-loop fasteners. For example, the first roll-up-securing patch 22 may include the hooks and the second roll-up-securing patch 24 may include the loops. As shown in FIGS. 2-4, the first roll-up-securing patch 22 may be sewn and/or adhesively bonded (or otherwise secured) to the second side 36 of the cover body 16 at or near the top end 30. The second roll-up-securing patch 24 may be sewn and/or adhesively bonded (or otherwise secured) to the first side 34 of the cover body 16 at a distance below the top end 30 such that when the cover body 16 is rolled into the rolled-up position, the second roll-up-securing patch 24 can be pressed into engagement with the first roll-up-securing patch 22 (i.e., to engage the hook-and-loop fasteners) to removably secure the cover body 16 in the rolled-up position.

The pull-strap 26 can be a fabric or polymeric strap. A first end 38 of the pull-strap 26 may be sewn and/or adhesively bonded (or otherwise secured) to the first side 34 of the cover body 16. For example, the first end 38 of the pull-strap 26 may be secured to the cover body 16 at a location adjacent to a portion of the second roll-up-securing patch 24. A second end 40 of the pull-strap 26 and an intermediate portion of the pull-strap 26 (between the first and second ends 40) may be unattached to the cover body 16 and may hang freely from the cover body 16. The pull-strap 26 should be positioned and sized to allow a person to easily grasp the pull-strap 26 when the window cover is in the rolled-up position and pull downward on the pull-strap 26 to release the second roll-up-securing patch 24 from the first roll-up-securing patch 22 to allow the cover body to drop into the deployed position. As shown in FIG. 2, when the cover body 16 is in the rolled-up position, a portion of the pull-strap 26 curls around a rolled-up portion of the cover body 16 and another portion (including the second end 40) of the pull-strap 26 hangs downward from the cover body 16. A person can grasp the portion of the pull-strap 26 that is hanging downward from the cover body 16 and pull downward to move the cover body 16 into the deployed position. The portion of the pull-strap that is curled around the rolled-up portion of the cover body 16 exerts a downward force (when the user pulls downward on the pull-strap) on the rolled-up cover body 16 that helps to disengage the first and second roll-up-securing patches 22, 24 from each other and move the cover body 16 into the deployed position more rapidly.

The weight 28 can be sewn into (or adhesively bonded or otherwise secured to) the cover body 16 at or near the bottom end 32 of the cover body 16. The weight 28 could be an elongated metallic rod, for example, and may span some or all of the width of the cover body 16. It will be appreciated, however, that the weight 28 could have any shape and/or be formed from any type of material (e.g., plastic, wood, etc.). Furthermore, the weight 28 could be a single piece or formed from a plurality of discrete pieces. The weight(s) 28 should have sufficient mass to help the cover body 16 to quickly drop from the rolled-up position to the deployed position when the second roll-up-securing patch 24 is disengaged from the first roll-up-securing patch 22. Furthermore, the weight 28 also helps to maintain the cover body 16 in a substantially flat, unrolled condition in the deployed position to more completely cover the window 12. Furthermore, the weight 28 could also provide stiffness at the bottom end 32 of the cover body 16 to allow a person to more easily roll the cover body 16 into the rolled-up position.

Figure 6:
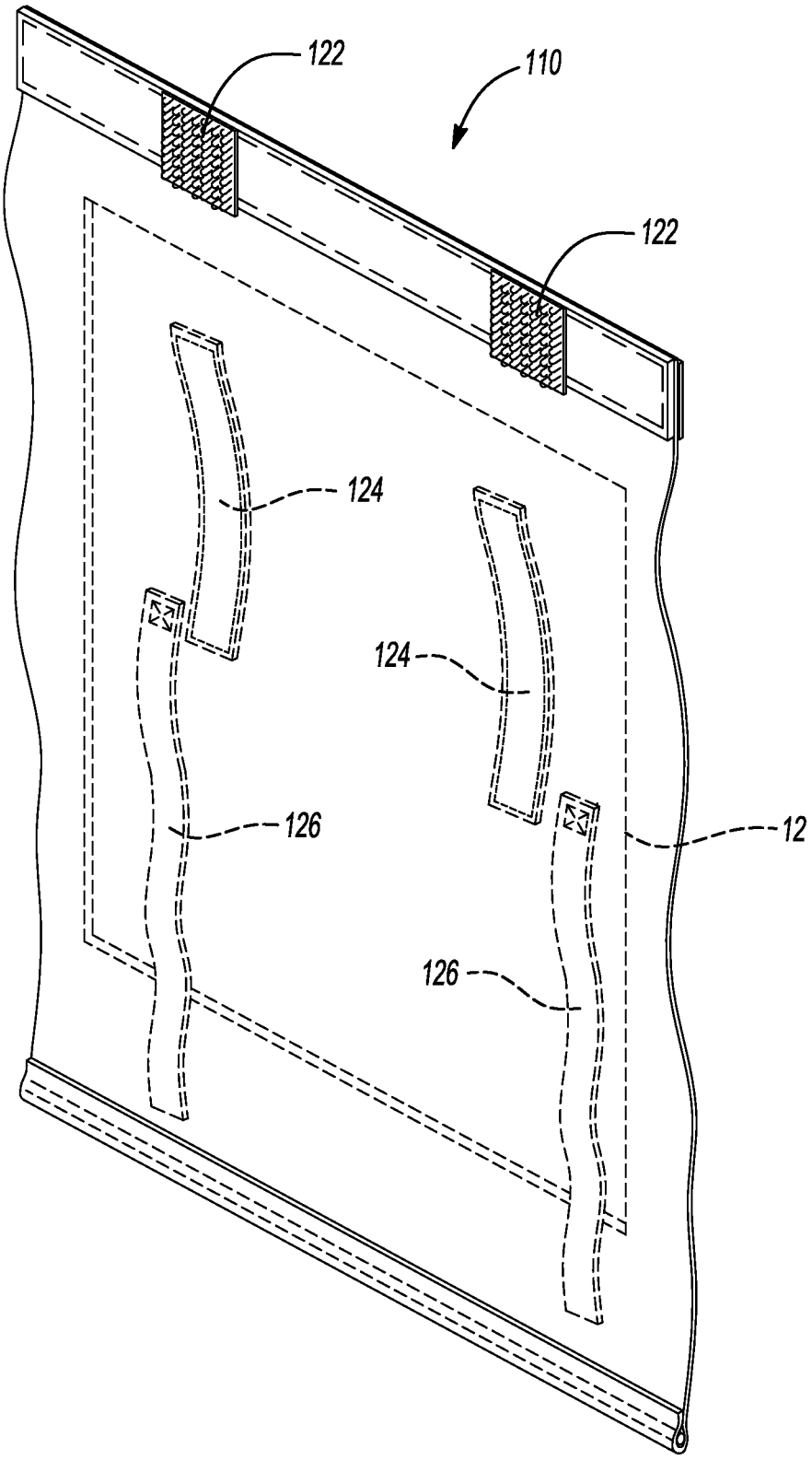
FIG. 6 is a perspective view of another configuration of a window cover according to the principles of the present disclosure.

With reference to FIG. 6, another rollup window cover 110 is provided that could be used to cover a wider window 12. The structure and function of the window cover 110 may be the same or identical to that of the window cover 10 shown in FIGS. 2-5, except the window cover 110 includes a plurality of second roll-up-securing patches 124 (each of which may be similar or identical to the second roll-up-securing patch 24) and a plurality of pull-straps 126 (each of which may be similar or identical to the pull-strap 26). One or more first roll-up-securing patches 122 (which may be similar or identical to the first roll-up-securing patch 22) may be provided to selectively engage the second roll-up-securing patches 124 to selectively retain the window cover 110 in the rolled-up position as described above.

Figure 7:
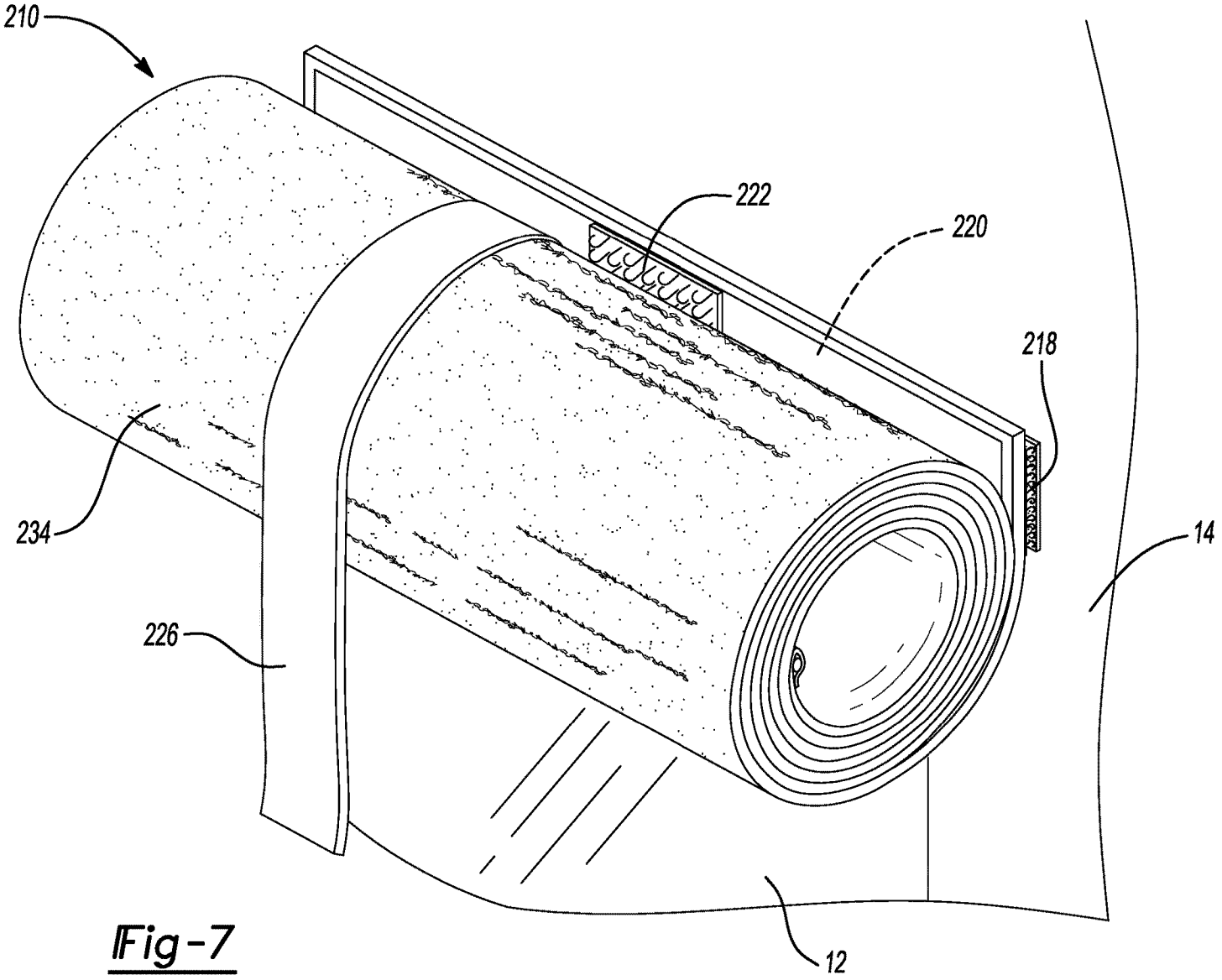
FIG. 7 is a perspective view of yet another configuration of a window cover according to the principles of the present disclosure.

With reference to FIG. 7, another rollup window cover 210 is provided that could be used to cover a window. The structure and function of the window cover 210 may be the same or identical to that of the window cover 10 or 110 described above, except the window cover 210 does not have a second roll-up-securing patch 24, 124. Instead, the entire first side 234 of the window cover 210 (i.e., the side of the window cover 210 that faces the window 12 when the cover is in the unrolled position) is formed from or covered with loop material for hook-and-loop engagement with one or more roll-up-securing patches 222 having hooks. Alternatively, the first side 234 could be formed from or covered with hooks and the patch 222 could include the loops.

The window cover 210 can include one or more pull-straps 226 (similar or identical to the pull-straps 26, 126 described above). The window cover 210 can be secured to the door 14 by hook-and-loop mounting patches 218, 220 (similar or identical to the hook-and-loop mounting patches 18, 20 described above). The window cover 210 may include other features of the window cover 10, 110 described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A window cover comprising:

a cover body having a top end, a bottom end, a first side, and a second side, wherein the cover body is configured to be moved between a rolled-up position and a deployed position;

a mounting feature secured to the first side of the cover body at or near the top end, wherein the mounting feature is configured to attach the top end of the cover body to a surface above a window;

a first roll-up-securing feature secured to the second side of the cover body at or near the top end;

the first side of the cover body including a second roll-up-securing feature between the top and bottom ends, wherein the second roll-up-securing feature is configured to removably engage the first roll-up-securing feature to retain the cover body in the rolled-up position; and a pull-strap attached to the cover body, wherein the pull-strap is accessible when the cover body is in the rolled-up position, wherein the pull-strap includes a first end and a second end, wherein the first end is fixedly attached to the first side of the cover body, and wherein the second end is unattached to the cover body, and wherein when the cover body is in the rolled-up position, a first portion of the pull-strap curls around a rolled-up portion of the cover body and a second portion of the pull-strap hangs downward from the cover body.

2. The window cover of claim 1, further comprising a weight attached to the cover body at the bottom end.

3. The window cover of claim 2, wherein the weight is a rod sewn into the cover body.

4. The window cover of claim 1, wherein the first and second roll-up securing features engage each other by hook-and-loop engagement.

5. The window cover of claim 4, wherein the first roll-up securing feature includes a first patch sewn to the second side of the cover body.

6. The window cover of claim 5, wherein the second roll-up securing feature includes a second patch sewn to the first side of the cover body.

7. The window cover of claim 6, wherein the first patch includes hooks of a hook-and-loop fastener, and the second patch includes loops of the hook-and-loop fastener.

8. The window cover of claim 5, wherein the second roll-up securing feature covers the entire first side of the cover body.

9. The window cover of claim 1, wherein the pull-strap is attached to the first side of the cover body, and wherein the first side of the cover body faces the window when the cover body is in the deployed position.

10. The window cover of claim 1, wherein the mounting feature includes a first mounting patch and a second mounting patch.

11. The window cover of claim 10, wherein the first mounting patch is secured to the surface above the window, wherein the second mounting patch is secured to the cover body at the top end.

12. The window cover of claim 11, wherein the first and second mounting patches form a hook-and-loop fastener.

13. The window cover of claim 1, wherein the cover body is formed from a fabric material.

14. The window cover of claim 1, wherein the cover body is opaque.

15. The window cover of claim 1, wherein the window is entirely blocked when the cover body is in the deployed position.

16. The window cover of claim 15, wherein the window is entirely uncovered when the cover body is in the rolled-up position.

17. A window cover comprising:

a cover body having a top end, a bottom end, a first side, and a second side, wherein the cover body is configured to be moved between a rolled-up position and a deployed position;

a first mounting patch secured to the first side of the cover body at or near the top end;

a second mounting patch secured to a surface above a window, wherein the first and second mounting patches engage each other by hook-and-loop engagement to attach the top end of the cover body to the surface above the window;

a first roll-up-securing feature secured to the second side of the cover body at or near the top end;

the first side of the cover body including a second roll-up-securing feature between the top and bottom ends, wherein the second roll-up-securing feature is configured to removably engage the first roll-up-securing feature to retain the cover body in the rolled-up position;

a weight attached to the cover body at the bottom end; and a pull-strap attached to the cover body, wherein the pull-strap is accessible when the cover body is in the rolled-up position, wherein the pull-strap is attached to the first side of the cover body, and wherein the first side of the cover body faces the window when the cover body is in the deployed position, wherein the pull-strap includes a first end and a second end, wherein the first end is fixedly attached to the first side of the cover body, and wherein the second end is unattached to the cover body, and wherein when the cover body is in the rolled-up position, a first portion of the pull-strap curls around a rolled-up portion of the cover body and a second portion of the pull-strap hangs downward from the cover body.

18. The window cover of claim 17, wherein the cover body is formed from an opaque fabric material, wherein the window is entirely blocked when the cover body is in the deployed position, and wherein the window is entirely uncovered when the cover body is in the rolled-up position.

19. The window cover of claim 17, wherein the first roll-up securing feature includes a first patch sewn to the second side of the cover body, wherein the second roll-up securing feature includes a second patch sewn to the first side of the cover body.

20. The window cover of claim 19, wherein the first and second patches engage each other by hook-and-loop engagement.

* * * * *